US006550204B1

(12) United States Patent
Herrera et al.

(10) Patent No.: US 6,550,204 B1
(45) Date of Patent: Apr. 22, 2003

(54) COMPOSITE DOOR CONSTRUCTION

(75) Inventors: Steve G. Herrera, Montebello, CA (US); Richard Harry Pangburn, Covina, CA (US); Alex D. Herrera, Los Alamitos, CA (US)

(73) Assignee: The Door Project, LLC, Los Alamitos, CA (US)

( * ) Notice: Subject to any disclaimer, the term of this patent is extended or adjusted under 35 U.S.C. 154(b) by 0 days.

(21) Appl. No.: 10/041,800

(22) Filed: Jan. 7, 2002

(51) Int. Cl.[7] ..... E06B 3/70; E06B 3/30; E06B 3/68

(52) U.S. Cl. ..... 52/455; 52/456; 52/204.53; 52/204.6

(58) Field of Search ..... 52/455, 456, 209, 52/204.53, 204.6

(56) References Cited

U.S. PATENT DOCUMENTS 2,851,742 A * 9/1958 Johnston ..... 52/204.53
3,443,345 A * 5/1969 Spencer ..... 49/504
3,724,129 A * 4/1973 Stromquist ..... 219/218
4,598,520 A * 7/1986 Ellstrom ..... 52/314
5,040,347 A * 8/1991 Valvis ..... 29/445
5,088,255 A * 2/1992 Emanuel ..... 52/395
5,291,710 A * 3/1994 Golen ..... 52/204.62
5,487,245 A * 1/1996 Dazo et al. ..... 52/204.591
5,737,890 A * 4/1998 Heyden ..... 52/455
5,791,752 A * 8/1998 Hartman ..... 312/204
6,240,685 B1 * 6/2001 Eichhorn ..... 52/204.61
6,301,852 B1 * 10/2001 Eshelman ..... 52/395

* cited by examiner

*Primary Examiner*—Carl D. Friedman
*Assistant Examiner*—Kevin McDermott
(74) *Attorney, Agent, or Firm*—David A. Belasco; Belasco, Jacobs & Townsley

(57) ABSTRACT

A composite door construction for exterior doors having one or more transparent panels is described. The doors include top and bottom rails and first and second side stiles. Each component includes an exterior cap of weather-resistant material. The caps are formed with a C-shaped cross-section yielding an interior cavity and include a supporting ledge extending from the innermost portion of the cap. An interior trim portion is shaped to fit into the C-shaped cross-section and an interior cavity. In doors having multiple transparent panels, one or more muntin bars support the inner edges of the panels. The muntin bars include an exterior cap with supporting ledges of weather-resistant material, an interior trim portion attached to a central groove in the exterior cap, and have drainage and sealant grooves. The outer portions and surfaces of the side stiles meet at an angle over ninety degrees to reduce binding between mating doors.

10 Claims, 4 Drawing Sheets

FIG. 1A
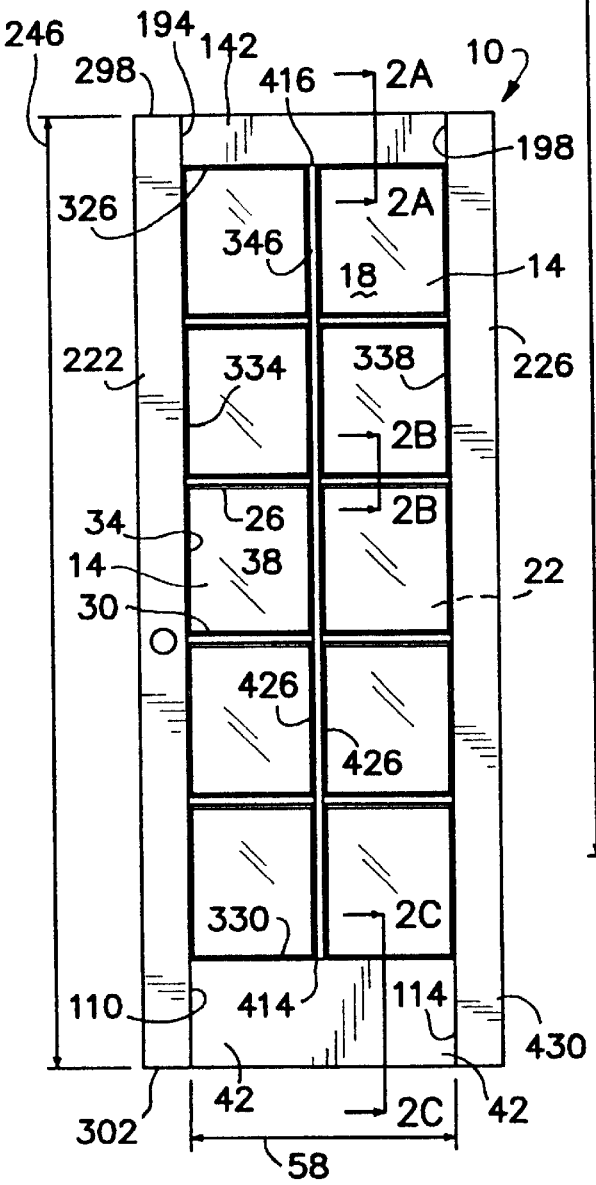
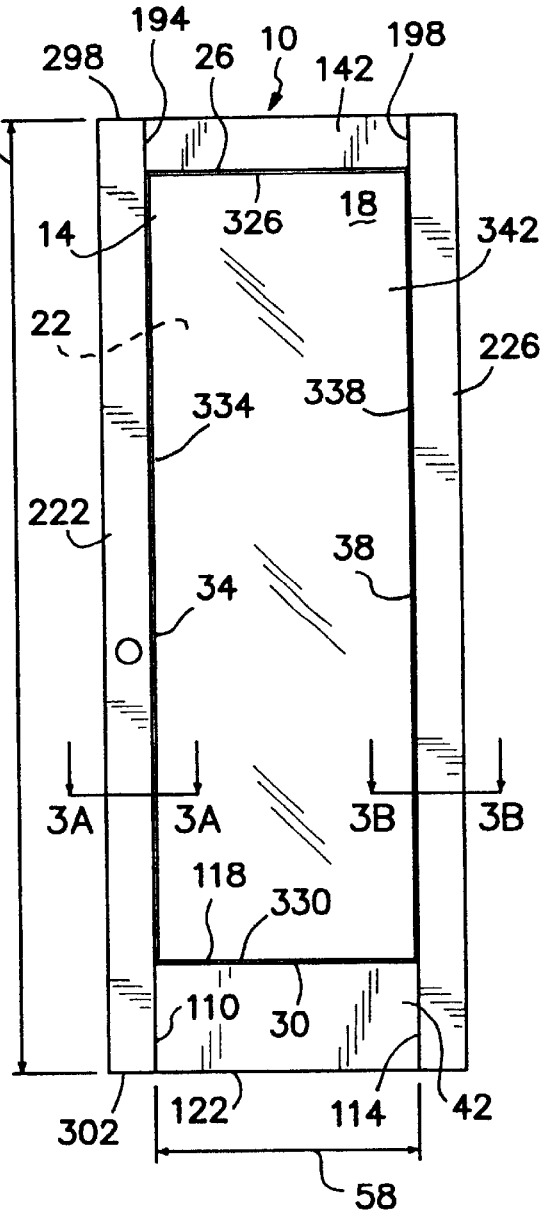
FIG. 1B

FIG. 2A
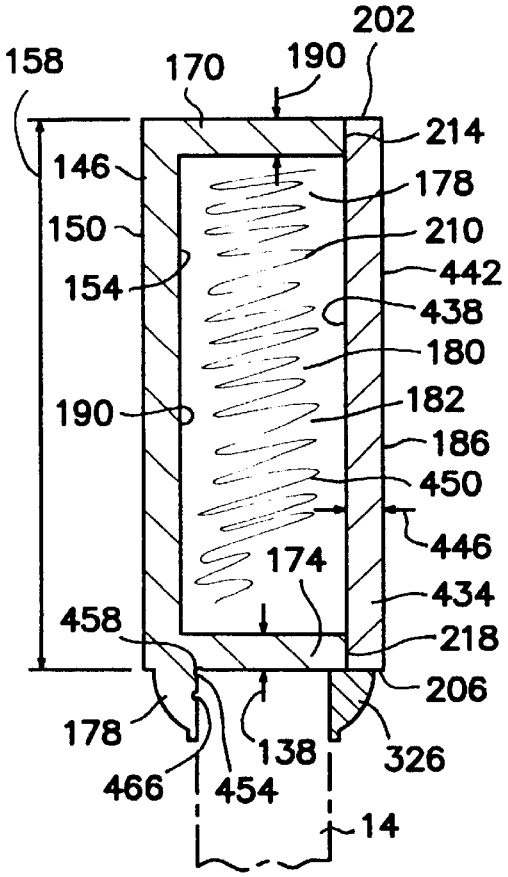
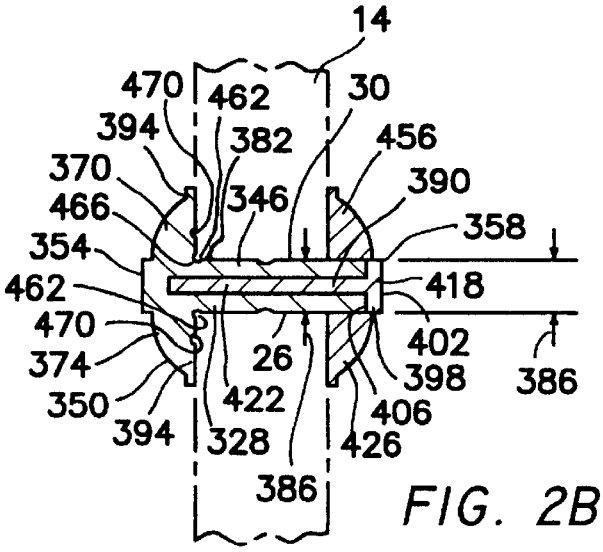
FIG. 2B
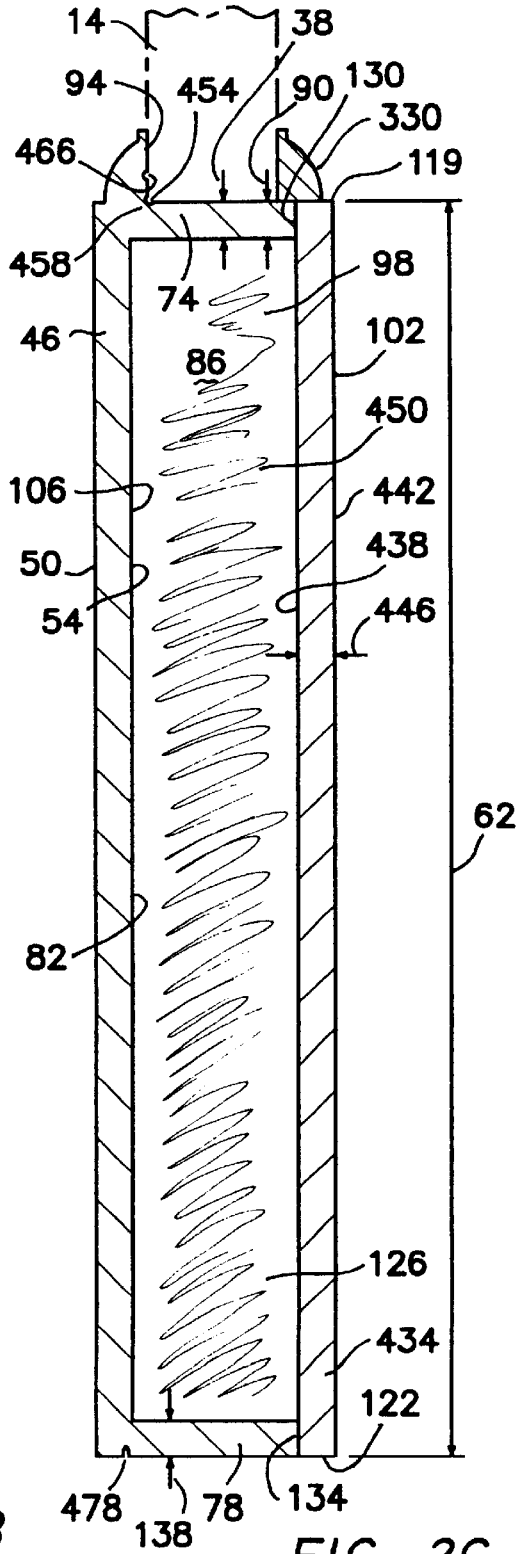
FIG. 2C

COMPOSITE DOOR CONSTRUCTION

FIELD OF INVENTION

The invention pertains to door construction. More particularly, the invention relates to the construction of doors for exterior use that include transparent panels, rugged exterior surfaces while providing for use of decorative interior surfaces.

BACKGROUND OF THE INVENTION

Various techniques have been developed for constructing doors that include transparent panels. The best of these techniques secure individual glass panels into a door construction rather than using a series of decorative strips to partition a single large glass panel. These techniques provide a more attractive appearance known as "true divided light", eliminating unsightly shadows resulting from the use of the decorative strips.

U.S. Pat. No. 6,054,207 issued to Finley is directed to a foamed thermoplastic polymer and wood fiber material that can be extruded into profile members that can be used in a window or door assembly that can be easily installed, adjusted, shimmed, and trimmed using conventional fasteners and techniques. The profile components can be used in applications where wooden components have been used, such as trim, posts, beams, shaped structural members, or for the construction of fenestration units. These foamed units can be used as a replacement for stone, glass, and metal members, as well as wood.

U.S. Pat. No. 4,328,644 issued to Scott et al., discloses a plastic clad window having a wooden frame that faces the interior of a building. A wooden frame element is pre-assembled and then mounted in an already fabricated plastic shell using mastic and a series of staples or other fasteners to attach the shell to the jamb parts. Sash members are constructed in a fashion similar to the frame. The rearward portion of the frame is exposed toward the space inside the building and can be finished and trimmed in any suitable manner.

U.S. Pat. No. 5,265,388, issued to Sherwood is directed to a simplified window assembly using an outside and inside frame molded of a plastic polymer such as high-density polyurethane foam. Window installation has a window assembly formed of a pair of frames holding a pane. The frames, injection molded or cast molded, may be constructed of plastic polymers such as high-density polyurethane foam. Several inserts that can be made from wood are used to strengthen the frames.

U.S. Pat. No. 6,148,582 issued to Ellingson discloses a doorjamb assembly comprising a brick mold plastic extrusion fastened to a board jamb member. The door jamb/brick mold assembly comprises a jamb member, a flat wooden board adhesively secured to a unitary brick mold and stop member. The co-extrusion that forms the jamb member is substantially solid with the interior portion extruded of a relatively less dense blown thermoplastic material with an exterior skin formed of a relatively more dense non-blown thermoplastic material. The jamb member is formed defining a rabbit shaped and sized to receive the outside edge of the jamb member.

U.S. Pat. No. 4,720,951 issued to Thorn et al. is directed to a frame assembly for doors, windows and the like that include multiple smaller panes of glass separated by individual interior frames. A window frame consists of a pair of outer skins and a spacer. The skins are molded from such materials as fiberglass reinforced plastics, pressed board, vinyl esters, polystyrenes, or other moldable materials. Skins have an edge that defines an opening for the glass panel and are adapted to embrace an insert that is positioned between them. The insert can be wood, wood fiber, thermoplastics, and glass fiber reinforced thermosets. After assembly, the cavity between the skins is filled with a foamed insulating material. Multiple smaller panes of glass separated by individual interior frames may be used instead of one large pane of glass.

While other variations exist, the above-described designs for door and window construction are typical of those encountered in the prior art. It is an objective of the present invention to provide door constructions that include a rugged, weather resistant outer surface while allowing for a variety of decorative interior treatments. It is a further objective to provide door constructions for doors with multiple transparent panels that incorporate "true divided light" treatment for the panels. It is a still further objective of the invention to provide the above-described features in an inexpensive and readily reproducible format adapted to a variety of standard size door openings. It is yet a further objective to provide door constructions that allow for the use of less expensive "fill materials" without sacrificing strength or exterior appearance.

While some of the objectives of the present invention are disclosed in the prior art, none of the inventions found include all of the requirements identified.

SUMMARY OF THE INVENTION

The present invention addresses many of the deficiencies of prior art composite door constructions and satisfies all of the objectives described above.

A composite door construction providing the desired features may be constructed from the following components. A transparent panel is provided. The panel has an inner surface, an outer surface, an upper edge, a lower edge and first and second side edges. A bottom rail is provided. The bottom rail includes a first exterior cap, the first cap is formed of weather-resistant material and has an outer surface, an inner surface, a first predetermined length, a first predetermined height, a first end, a second end, a top portion, a bottom portion, and a C-shaped cross-section. The C-shaped cross-section forms an interior cavity. The top and bottom portions have a first predetermined thickness.

The top portion has a first ledge extending from it. The first ledge is sized and shaped to receive the lower edge of the transparent panel. A first interior trim portion is provided. The first trim portion has an outer surface, an inner surface, the first predetermined length, the first predetermined height, a first end, a second end, a top edge, a bottom edge and a rectangular cross-section.

The first trim portion includes upper and lower receiving notches in the top and bottom edges, respectively. The receiving notches are located adjacent the outer surface of the first trim portion and having a depth equal to the first predetermined thickness. The first interior trim portion is attached to the first exterior cap with the top and bottom portions located within the upper and lower receiving notches and the inner surface of the first trim portion located adjacent the inner surface of the first exterior cap. A top rail is provided. The top rail includes a second exterior cap.

The second cap is formed of weather-resistant material and has an outer surface, an inner surface, the first predetermined length, a second predetermined height, a first end, a second end, a top portion, a bottom portion, and a C-shaped cross-section. The C-shaped cross-section forms an interior cavity. The top and bottom portions have the first predetermined thickness. The bottom portion has a second ledge extending from it. The second ledge is sized and shaped to receive the upper edge of the transparent panel. A second interior trim portion is provided. The second trim portion has an outer surface, an inner surface, the first predetermined length, the second predetermined height, a first end, a second end, a top edge, a bottom edge and a rectangular cross-section.

The second trim portion includes upper and lower receiving notches in the top and bottom edges, respectively. The receiving notches are located adjacent the outer surface of the second trim portion and having a depth equal to the first predetermined thickness. The second interior trim portion is attached to the second exterior cap with the top and bottom portions located within the upper and lower receiving notches and the inner surface of the second trim portion located adjacent the inner surface of the second exterior cap.

First and second side stiles are provided. The first and second side stiles include third and fourth exterior caps. Each of the third and fourth caps are formed of weather-resistant material and have an outer surface, an inner surface, a second predetermined length, the second predetermined height, an upper end, a lower end, an inner portion, an outer portion, and a C-shaped cross-section. The C-shaped cross-section forms an interior cavity. The inner and outer portions have the first predetermined thickness. The inner portions have third and fourth ledges extending from them. The third and fourth ledges are sized and shaped to receive the first and second side edges of the transparent panel.

Third and fourth interior trim portions are provided. The third and fourth trim portions have an outer surface, an inner surface, the second predetermined length, the second predetermined height, a first end, a second end, an inner edge, an outer edge and a rectangular cross-section. The third and fourth trim portions include inner and outer receiving notches in the inner and outer edges, respectively. The receiving notches are located adjacent the outer surface of the third and fourth trim portion and having a depth equal to the first predetermined thickness. The third and fourth interior trim portions are attached to the third and fourth exterior caps with the inner and outer portions located within the inner and outer receiving notches. The inner surface of the third and fourth trim portions are located adjacent the inner surface of the third and fourth exterior caps.

The bottom rail is attached between the first and second side stiles adjacent their lower ends. The top rail is attached between the first and second side stiles adjacent their upper ends. The transparent panel is located on the first, second, third and forth ledges. Upper and lower panel retention strips are provided. The upper and lower strips are attached to the top and bottom rails, extend from the first side stile to the second side stile and serve to secure the upper and lower edges of the transparent panel. First side and second side panel retention strips are provided. The first side and second side strips are attached to the first side and second side stiles, extend from the top rail to the bottom rail and serve to secure the first and second side edges of the transparent panel.

When the top and bottom rails are attached between the first and second side stiles at their upper and lower ends, the transparent panel is located on the first, second, third and forth ledges and secured in place with the upper and lower panel retention strips and the first side and second side panel retention strips, a door having a transparent panel will be formed.

In a variant of the invention, at least two transparent panels are provided. Each of the panels has an inner surface, an outer surface, an upper edge, a lower edge and first and second side edges. A bottom rail is provided. The bottom rail includes a first exterior cap. The first cap is formed of weather-resistant material and has an outer surface, an inner surface, a first predetermined length, a first predetermined height, a first end, a second end, a top portion, a bottom portion, and a C-shaped cross-section. The C-shaped cross-section forms an interior cavity. The top and bottom portions have a first predetermined thickness. The top portion has a first ledge extending from it. The first ledge is sized and shaped to receive the lower edge of the transparent panel. A first interior trim portion is provided. The first trim portion has an outer surface, an inner surface, the first predetermined length, the first predetermined height, a first end, a second end, a top edge, a bottom edge and a rectangular cross-section.

The first trim portion includes upper and lower receiving notches in the top and bottom edges, respectively. The receiving notches are located adjacent the outer surface of the first trim portion and having a depth equal to the first predetermined thickness. The first interior trim portion is attached to the first exterior cap with the top and bottom portions located within the upper and lower receiving notches and the inner surface of the first trim portion located adjacent the inner surface of the first exterior cap. A top rail is provided. The top rail includes a second exterior cap. The second cap is formed of weather-resistant material and has an outer surface, an inner surface, the first predetermined length, a second predetermined height, a first end, a second end, a top portion, a bottom portion, and a C-shaped cross-section. The C-shaped cross-section forms an interior cavity.

The top and bottom portions have the first predetermined thickness. The bottom portion has a second ledge extending from it. The second ledge is sized and shaped to receive the upper edge of the transparent panel. A second interior trim portion is provided. The second trim portion has an outer surface, an inner surface, the first predetermined length, the second predetermined height, a first end, a second end, a top edge, a bottom edge and a rectangular cross-section. The second trim portion includes upper and lower receiving notches in the top and bottom edges, respectively. The receiving notches are located adjacent the outer surface of the second trim portion and having a depth equal to the first predetermined thickness. The second interior trim portion is attached to the second exterior cap with the top and bottom portions located within the upper and lower receiving notches and the inner surface of the second trim portion located adjacent the inner surface of the second exterior cap.

First and second side stiles are provided. The first and second side stiles include third and fourth exterior caps. Each of the third and fourth caps are formed of weather-resistant material and have an outer surface, an inner surface, a second predetermined length, the second predetermined height, an upper end, a lower end, an inner portion, an outer portion, and a C-shaped cross-section. The C-shaped cross-section forms an interior cavity, the inner and outer portions have the first predetermined thickness. The inner portions have third and fourth ledges extending from them. The third and fourth ledges are sized and shaped to receive the first and second side edges of the transparent panel.

Third and fourth interior trim portions are provided. The third and fourth trim portions have an outer surface, an inner surface, the second predetermined length, the second predetermined height, a first end, a second end, an inner edge, an outer edge and a rectangular cross-section. The third and fourth trim portions include inner and outer receiving notches in the inner and outer edges, respectively. The receiving notches are located adjacent the outer surface of the third and fourth trim portion and have a depth equal to the first predetermined thickness. The third and fourth interior trim portions are attached to the third and fourth exterior caps with the inner and outer portions located within the inner and outer receiving notches. The inner surfaces of the third and fourth trim portions are located adjacent the inner surface of the third and fourth exterior caps.

The bottom rail is attached between the first and second side stiles adjacent their lower ends. The top rail is attached between the first and second side stiles adjacent their upper ends. At least one muntin bar is provided. The muntin bar includes a fifth exterior cap. The fifth cap is formed of weather-resistant material and has an outer surface, an inner surface, a first end, a second end, a first portion, a second portion, a central portion, and a T-shaped cross-section. The central portion of the fifth cap has a first predetermined width and a longitudinal groove. Each of the first and second portions has a supporting ledge extending from it. The supporting ledge is sized and shaped to receive an edge of one of the transparent panels.

A muntin bar interior trim portion is provided. The muntin bar trim portion has an outer surface, an inner surface, the first predetermined width, a first end, a second end and a rectangular cross-section. The muntin bar trim portion has a longitudinal tongue extending outwardly from its inner surface. The tongue is sized shaped and located to frictionally engage the groove in the central portion of the fifth exterior cap. The muntin bar trim portion is attached to the central portion of the fifth exterior cap with the inner surface of the fifth cap abutting the inner surface of the muntin bar trim portion with the groove engaging the tongue. The muntin bar extends from either the top rail to the bottom rail or the first side stile to the second side stile. Each of the transparent panels is located upon either of the first, second, third and forth ledges and one of the supporting ledges of the fifth exterior cap of the muntin bar.

Upper and lower panel retention strips are provided. The upper and lower strips are attached to the top and bottom rails, and serve to secure the upper and lower edges of the transparent panels. First side and second side panel retention strips are provided. The first side and second side strips are attached to the first side and second side stiles, and serve to secure the first and second side edges of the transparent panels. Muntin bar panel retention strips are provided. The muntin bar panel retention strips are attached to the muntin bar interior trim portion and serve to secure the first and second side edges and the upper and lower edges of the transparent panels.

When the top and bottom rails are attached between the first and second side stiles at their upper and lower ends, the transparent panels are located on the first, second, third, forth and supporting ledges and secured in place with the upper and lower panel retention strips, the first side and second side panel retention strips, and the muntin bar panel retention strips, a door having at least two transparent panel will be formed.

In another variant, the first, second, third and fourth interior trim portions further include a decorative inner panel. The decorative inner panel has an inside surface and an outside surface and extends from the outer surface of the trim portions toward the inner surface of the trim portions for a first predetermined distance. A filler portion is provided. The filler portion extends from the inside surface of the decorative inner panel to the inner surface of the trim portions. The decorative inner panel is fixedly attached to the filler portion. The filler portion may be fabricated from less expensive materials, thereby reducing the cost of the door.

In still another variant, the first, second, third and fourth exterior caps further include a first drainage groove. The first drainage groove is located at an intersection of either of the top portion, bottom portion and inner portion of the exterior caps and the first, second, third and fourth ledges. The first drainage groove extends from the first end to the second end and from the upper end to the lower end of the exterior caps.

In yet another variant of the invention, the fifth exterior cap of the muntin bar further includes a second drainage groove. The second drainage groove is located at an intersection of either of the first and second portions of the fifth exterior cap and the supporting ledges. The second drainage groove extends from the first end to the second end of the fifth exterior cap of the muntin bar.

In a further variant, the first, second, third and fourth exterior caps further include a first sealant groove. The first sealant groove is located on each of the first, second, third and fourth ledges. The first sealant groove is spaced from an intersection of either of the top portion, bottom portion and inner portion of the exterior caps and the first, second, third and fourth ledges. The first sealant groove extends from the first end to the second end and from the upper end to the lower end of the exterior caps.

In still a further variant, the fifth exterior cap of the muntin bar further includes a second sealant groove. The second sealant groove is located on each of the supporting ledges and spaced from an intersection of either of the first and second portions of the fifth exterior cap and the supporting ledges. The second sealant groove extends from the first end to the second end of the fifth exterior cap of the muntin bar.

In another variant of the invention, the bottom rail further includes a first drip stop groove. The first drip stop groove is located on the bottom portion of the first exterior cap and is spaced inwardly from and parallel to the outer surface and extends from the first end to the second end of the first exterior cap. When the door construction is located adjacent a ground surface, the first drip stop groove will serve to prevent water from running underneath the bottom portion of the bottom rail.

In yet another variant, at least one of the first and second sides stiles further includes a second drip stop groove. The second drip stop groove is located on the outer portion of at least one of the third and fourth exterior caps and is spaced inwardly from and parallel to the outer surface. The second drip stop groove extends from the upper end to the lower end of at least one of the third and fourth exterior caps. When the door construction is located adjacent a second door construction, the second drip stop groove will serve to prevent water from entering past the side stiles.

In a final variant of the invention, the outer portion of either of the first and second side stiles meets the outer surface the side stiles at an angle of slightly greater than ninety degrees, thereby reducing binding when two such door constructions are abutted together at the outer portions.

An appreciation of the other aims and objectives of the present invention and an understanding of it may be achieved by referring to the accompanying drawings and the detailed description of a preferred embodiment.

DESCRIPTION OF THE DRAWINGS

FIG. 1A is a front view of the preferred embodiment of the invention illustrating multiple transparent panels, top and bottom rails, first and second side stiles and muntin bars;

FIG. 1B is a front view of a second embodiment of the invention illustrating a single transparent panel, top and bottom rails and first and second side stiles;

FIG. 2A is a cross-sectional view of the top rail of the FIG. 1A embodiment taken along the line 2A—2A;

FIG. 2B is a cross-sectional view of a muntin bar of the FIG. 1A embodiment taken along the line 2B—2B;

FIG. 2C is a cross-sectional view of the bottom rail of the FIG. 1A embodiment taken along the line 2C—2C;

DETAILED DESCRIPTION OF THE PREFERRED EMBODIMENT

Figure 3B:
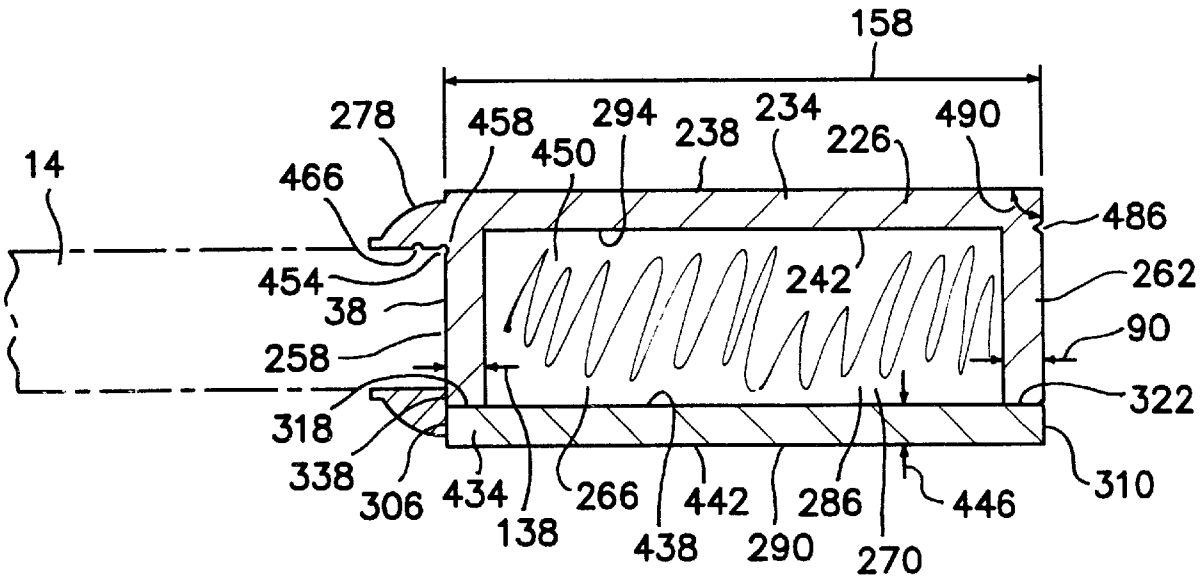
FIG. 3B is a cross-sectional view of the first side stile of the FIG. 1B embodiment taken along the line 3B—3B.

FIGS. 1A–4 illustrate a composite door construction 10 providing the desired features that may be constructed from the following components. As illustrated in FIG. 1B, a transparent panel 14 is provided. The panel 14 has an inner surface 18, an outer surface 22, an upper edge 26, a lower edge 30 and first 34 and second 38 side edges. A bottom rail 42 is provided. The bottom rail 42, as illustrated in FIGS. 1B and 2C, includes a first exterior cap 46, the first cap 46 is formed of weather-resistant material and has an outer surface 50, an inner surface 54, a first predetermined length 58, a first predetermined height 62, a first end (not shown), a second end (not shown), a top portion 74, a bottom portion 78, and a C-shaped cross-section 82. The C-shaped cross-section 82 forms an interior cavity 86. The top 74 and bottom 78 portions have a first predetermined thickness 90.

The top portion 74 has a first ledge 94 extending from it. The first ledge 94 is sized and shaped to receive the lower edge 30 of the transparent panel 14. A first interior trim portion 98 is provided. The first trim portion 98 has an outer surface 102, an inner surface 106, the first predetermined length 58, the first predetermined height 62, a first end 110, a second end 114, a top edge 118, a bottom edge 122 and a rectangular cross-section 126.

The first trim portion 98 includes upper 130 and lower 134 receiving notches in the top 118 and bottom 122 edges, respectively. The receiving notches 130, 134 are located adjacent the outer surface 102 of the first trim portion 98 and have a depth 138 equal to the first predetermined thickness 90. The first interior trim portion 98 is attached to the first exterior cap 46 with the top 74 and bottom 78 portions located within the upper 130 and lower 134 receiving notches and the inner surface 106 of the first trim portion 98 located adjacent the inner surface 54 of the first exterior cap 46.

Figure 4:
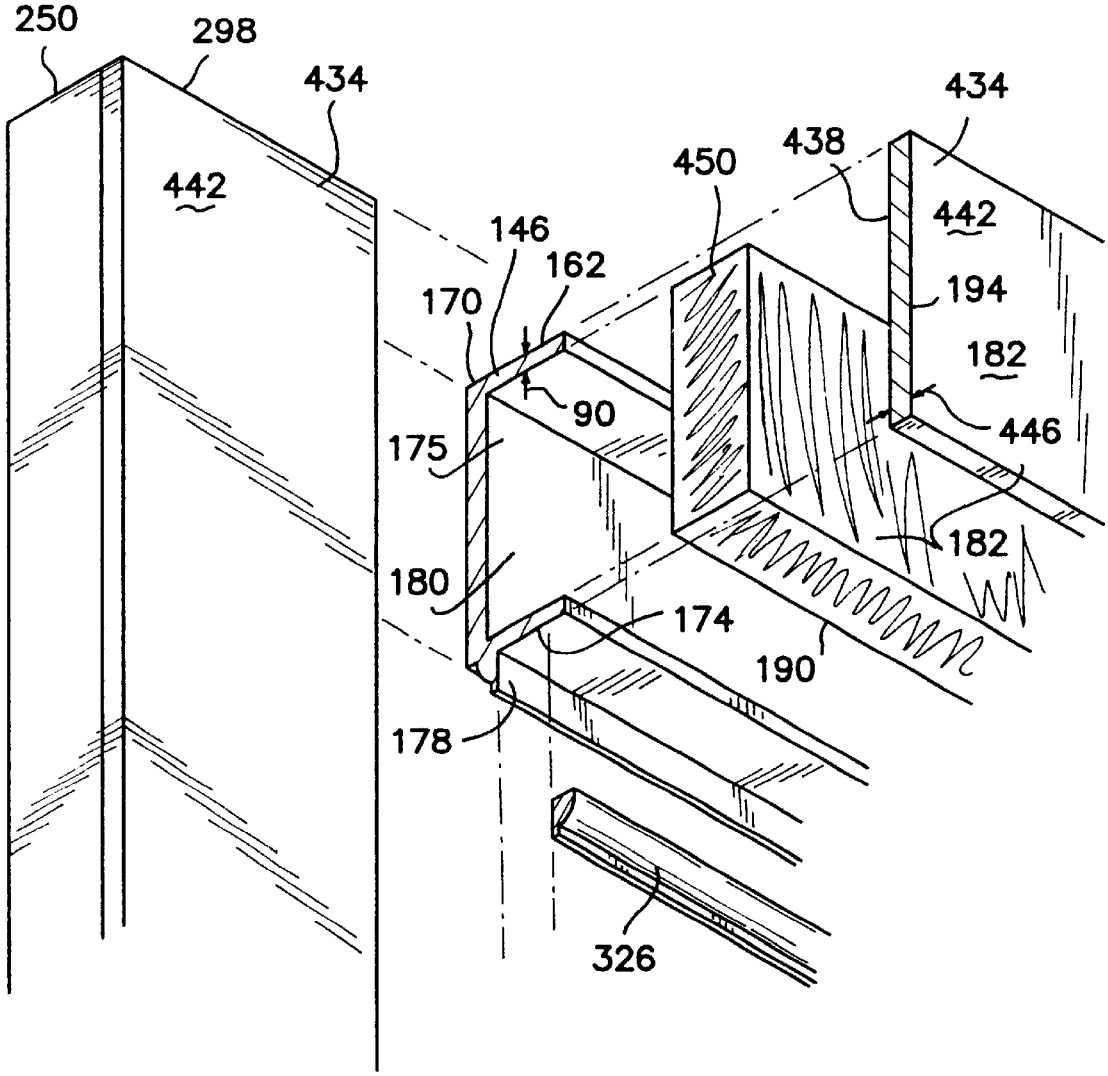
FIG. 4 is an exploded perspective detailed view of the top rail, illustrating the second exterior cap, filler portion, interior trim and securing trim.

As illustrated in FIGS. 1B, 2A and 4, a top rail 142 is provided. The top rail 142 includes a second exterior cap 146. The second cap 146 is formed of weather-resistant material and has an outer surface 150, an inner surface 154, the first predetermined length 58, a second predetermined height 158, a first end 162, a second end (not shown), a top portion 170, a bottom portion 174, and a C-shaped cross-section 178. The C-shaped cross-section 178 forms an interior cavity 180. The top 170 and bottom 174 portions have the first predetermined thickness 90. The bottom portion 174 has a second ledge 178 extending from it. The second ledge 178 is sized and shaped to receive the upper edge 26 of the transparent panel 14. A second interior trim portion 182 is provided. The second trim portion 182 has an outer surface 186, an inner surface 190, the first predetermined length 58, the second predetermined height 158, a first end 194, a second end 198, a top edge 202, a bottom edge 206 and a rectangular cross-section 210.

The second trim portion 182 includes upper 214 and lower 218 receiving notches in the top 202 and bottom 206 edges, respectively. The receiving notches 214, 218 are located adjacent the outer surface 186 of the second trim portion 182 and have a depth 138 equal to the first predetermined thickness 90. The second interior trim portion 182 is attached to the second exterior cap 146 with the top 170 and bottom 174 portions located within the upper 214 and lower 218 receiving notches and the inner surface 190 of the second trim portion 182 located adjacent the inner surface 154 of the second exterior cap 146.

As illustrated in FIGS. 1B, 3A, 3B and 4, first 222 and second 226 side stiles are provided. The first 222 and second 226 side stiles include third 230 and fourth 234 exterior caps. Each of the third 230 and fourth 234 caps are formed of weather-resistant material and have an outer surface 238, an inner surface 242, a second predetermined length 246, the second predetermined height 158, an upper end 250, a lower end (not shown), an inner portion 258, an outer portion 262, and a C-shaped cross-section 266. The C-shaped cross-section 266 forms an interior cavity 270. The inner 258 and outer 262 portions have the first predetermined thickness 90.. The inner portions 258 have third 274 and fourth 278 ledges extending from them. The third 274 and fourth 278 ledges are sized arid shaped to receive the first 34 and second 38 side edges of the transparent panel 14.

Third 282 and fourth 286 interior trim portions are provided. The third 282 and fourth 286 trim portions have an outer surface 290, an inner surface 294, the second predetermined length 246, the second predetermined height 158, a first end 298, a second end 302, an inner edge 306, an outer edge 310 and a rectangular cross-section 314. The third 282 and fourth 286 trim portions include inner 318 and outer 322 receiving notches in the inner 306 and outer 310 edges, respectively. The receiving notches 318, 322 are located adjacent the outer surface 290 of the third 282 and fourth 286 trim portion and have a depth 138 equal to the first predetermined thickness 90. The third 282 and fourth 286 interior trim portions are attached to the third 230 and fourth 234 exterior caps with the inner 258 and outer 262 portions located within the inner 318 and outer 322 receiving notches. The inner surfaces 294 of the third 282 and fourth 286 trim portions are located adjacent the inner surfaces 294 of the third 230 and fourth 234 exterior caps.

The bottom rail 42 is attached between the first 222 and second 226 side stiles adjacent their lower ends. The top rail 142 is attached between the first 222 and second 226 side stiles adjacent their upper ends 250. The transparent panel 14 is located on the first 94, second 178, third 274 and forth 278 ledges. Upper 326 and lower 330 panel retention strips are provided. The upper 326 and lower 330 strips are attached to the top 142 and bottom rails 42, extend from the first side stile 222 to the second side stile 226 and serve to secure the upper 26 and lower 30 edges of the transparent panel 14. First side 334 and second 338 side panel retention strips are provided. The first side 334 and second side 338 strips are attached to the first side 222 and second side 226 stiles, extend from the top rail 142 to the bottom rail 42 and serve to secure the first 34 and second 38 side edges of the transparent panel 14.

When the top 142 and bottom 42 rails are attached between the first 222 and second 226 side stiles at their upper 250 and lower ends, the transparent panel 14 is located on the first 94, second 178, third 274 and forth 278 ledges and secured in place with the upper 326 and lower 330 panel retention strips and the first side 334 and second side 338 panel retention strips, a door 342 having a transparent panel 14 will be formed.

In a variant of the invention, as illustrated in FIGS. 1A, at least two transparent panels 14 are provided. Each of the panels 14 has an inner surface 18, an outer surface 22, an upper edge 26, a lower edge 30 and first 34 and second 38 side edges. A bottom rail 42 is provided. The bottom rail 42, as illustrated in FIGS. 1A and 2C, includes a first exterior cap 46, the first cap 46 is formed of weather-resistant material and has an outer surface 50, an inner surface 54, a first predetermined length 58, a first predetermined height 62, a first end (not shown), a second end (not shown), a top portion 74, a bottom portion 78, and a C-shaped cross-section 82. The C-shaped cross-section 82 forms an interior cavity 86. The top 74 and bottom 78 portions have a first predetermined thickness 90.

The top portion 74 has a first ledge 94 extending from it. The first ledge 94 is sized and shaped to receive the lower edge 30 of the transparent panel 14. A first interior trim portion 98 is provided. The first trim portion 98 has an outer surface 102, an inner surface 106, the first predetermined length 58, the first predetermined height 62, a first end 110, a second end 114, a top edge 118, a bottom edge 122 and a rectangular cross-section 126.

The first trim portion 98 includes upper 130 and lower 134 receiving notches in the top 118 and bottom 122 edges, respectively. The receiving notches 130, 134 are located adjacent the outer surface 102 of the first trim portion 98 and have a depth 138 equal to the first predetermined thickness 90. The first interior trim portion 98 is attached to the first exterior cap 46 with the top 74 and bottom 78 portions located within the upper 130 and lower 134 receiving notches and the inner surface 106 of the first trim portion 98 located adjacent the inner surface 54 of the first exterior cap 46.

As illustrated in FIGS. 1A and 2A, a top rail 142 is provided. The top rail 142 includes a second exterior cap 146. The second cap 146 is formed of weather-resistant material and has an outer surface 150, an inner surface 154, the first predetermined length 58, a second predetermined height 158, a first end 162, a second end 166, a top portion 170, a bottom portion 174, and a C-shaped cross-section 178. The C-shaped cross-section 178 forms an interior cavity 182. The top 170 and bottom 174 portions have the first predetermined thickness 90. The bottom portion 174 has a second ledge 178 extending from it. The second ledge 178 is sized and shaped to receive the upper edge 26 of the transparent panel 14. A second interior trim portion 182 is provided. The second trim portion 182 has an outer surface 186, an inner surface 190, the first predetermined length 62, the second predetermined height 158, a first end 194, a second end 198, a top edge 202, a bottom edge 206 and a rectangular cross-section 210.

The second trim portion 182 includes upper 214 and lower 218 receiving notches in the top 202 and bottom 206 edges, respectively. The receiving notches 214, 218 are located adjacent the outer surface 186 of the second trim portion 182 and have a depth 138 equal to the first predetermined thickness 90. The second interior trim portion 182 is attached to the second exterior cap 146 with the top 170 and bottom 174 portions located within the upper 214 and lower 218 receiving notches and the inner surface 190 of the second trim portion 182 located adjacent the inner surface 154 of the second exterior cap 146.

Figure 3A:
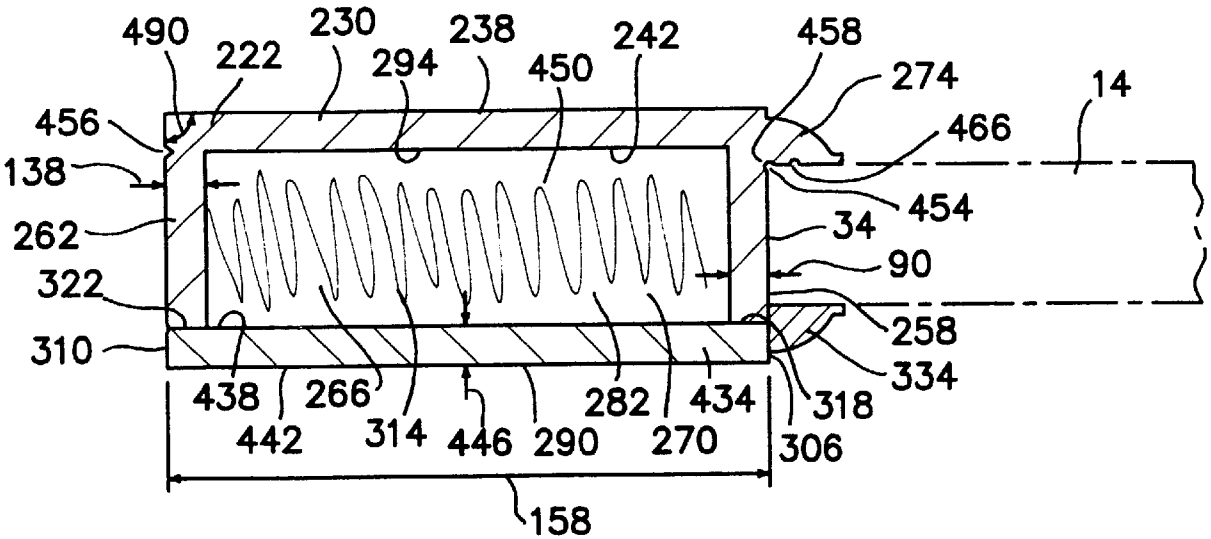
FIG. 3A is a cross-sectional view of the first side stile of the FIG. 1B embodiment taken along the line 3A—3A.

As illustrated in FIGS. 1A, 3A and 3B, first 222 and second 226 side stiles are provided. The first 222 and second 226 side stiles include third 230 and fourth 234 exterior caps. Each of the third 230 and fourth 234 caps are formed of weather-resistant material and have an outer surface 238, an inner surface 242, a second predetermined length 246, the second predetermined height 158, an upper end 250, a lower end, an inner portion 258, an outer portion 262, and a C-shaped cross-section 266. The C-shaped cross-section 266 forms an interior cavity 270. The inner 258 and outer 262 portions have the first predetermined thickness 90. The inner portions 258 have third 274 and fourth 278 ledges extending from them. The third 274 and fourth 278 ledges are sized and shaped to receive the first 34 and second 38 side edges of the transparent panel 14.

Third 282 and fourth 286 interior trim portions are provided. The third 282 and fourth 286 trim portions have an outer surface 290, an inner surface 294, the second predetermined length 246, the second predetermined height 158, a first end 298, a second end 302, an inner edge 306, an outer edge 310 and a rectangular cross-section 314. The third 282 and fourth 286 trim portions include inner 318 and outer 322 receiving notches in the inner 306 and outer 310 edges, respectively. The receiving notches 318, 322 are located adjacent the outer surface 290 of the third 282 and fourth 286 trim portion and have a depth 138 equal to the first predetermined thickness 90. The third 282 and fourth 286 interior trim portions are attached to the third 230 and fourth 234 exterior caps with the inner 258 and outer 262 portions located within the inner 318 and outer 322 receiving notches. The inner surfaces 294 of the third 282 and fourth 286 trim portions are located adjacent the inner surfaces of the third 230 and fourth 234 exterior caps.

The bottom rail 42 is attached between the first 222 and second 226 side stiles adjacent their lower ends. The top rail 142 is attached between the first 222 and second 226 side stiles adjacent their upper ends 250. As illustrated in FIGS. 1A and 2B, at least one muntin bar 346 is provided. The muntin bar 346 includes a fifth exterior cap 350. The fifth cap 350 is formed of weather-resistant material and has an outer surface 354, an inner surface 358, a first end (not shown), a second end (not shown), a first portion 370, a second portion 374, a central portion 378, and a T-shaped cross-section 382. The central portion 378 of the fifth cap 350 has a first predetermined width 386 and a longitudinal groove 390. Each of the first 370 and second 374 portions has a supporting ledge 394 extending from it. The supporting ledge 394 is sized and shaped to receive an edge 26, 30, 34, 38 of one of the transparent panels 14.

A muntin bar interior trim portion 398 is provided. The muntin bar trim portion 398 has an outer surface 402, an inner surface 406, the first predetermined width 386, a first end 410, a second end 414 and a rectangular cross-section 418. The muntin bar trim portion 398 has a longitudinal tongue 422 extending outwardly from its inner surface 406. The tongue 422 is sized shaped and located to frictionally engage the groove 390 in the central portion 378 of the fifth exterior cap 350. The muntin bar trim portion 398 is attached to the central portion 378 of the fifth exterior cap 350 with the inner surface 358 of the fifth cap 350 abutting the inner surface 406 of the muntin bar trim. portion 398 with the groove 390 engaging the tongue, 422. The muntin bar 346 extends from either the top rail 142 to the bottom rail 42 or the first side stile 222 to the second side stile 226. Each of the transparent panels 14 is located upon either of the first 94, second 178, third 274 and forth 278 ledges and one of the supporting ledges 394 of the fifth exterior cap 350 of the muntin bar 346.

As illustrated in FIGS. 1A, 2A and 2C, upper 326 and lower 330 panel retention strips are provided. The upper 326 and lower 330 strips are attached to the top 142 and bottom rails 42, and serve to secure the upper 26 and lower 30 edges of the transparent panels 14. First side 334 and second side 338 panel retention strips are provided. The first side 334 and second side 338 strips are attached to the first side 222 and second side 226 stiles, and serve to secure the first 34 and second 38 side edges of the transparent panels 14. Muntin bar panel retention strips 426 are provided. The muntin bar panel retention strips 426 are attached to the muntin bar interior trim portion 398 and serve to secure the first 34 and second 38 side edges and the upper 26 and lower 30 edges of the transparent panels 14.

When the top 142 and bottom 42 rails are attached between the first 222 and second 226 side stiles at their upper 250 and lower ends, the transparent panels 14 are located on the first 94, second 178, third 274, forth 278 and supporting ledges 394 and secured in place with the upper 326 and lower 330 panel retention strips, the first side 334 and second side 338 panel retention strips, and the muntin bar panel retention strips 426, a door 430 having at least two transparent panel 14 will be formed.

In another variant, as illustrated in FIGS. 2A, 2C, 3A, 3B and 4, the first 98, second 182, third 282 and fourth 286 interior trim portions further include a decorative inner panel 434. The decorative inner panel 434 has an inside surface 438 and an outside surface 442 and extends from the outer surface 102, 186, 290 of the trim portions toward the inner surface 106, 190, 294 of the trim portions 98, 182, 282, 286 for a first predetermined distance 446. A filler portion 450 is provided. The filler portion 450 extends from the inside surface 438 of the decorative inner panel 434 to the inner surface 106, 190, 294 of the trim portions 98, 182, 282, 286. The decorative inner panel 434 is fixedly attached to the filler portion 450. The filler portion 450 may be fabricated from less expensive materials, thereby reducing the cost of the door 342, 430.

In still another variant, as illustrated in FIGS. 2A, 2C, 3A and 3B, the first 46, second 146, third 230 and fourth 234 exterior caps further include a first drainage groove 454. The first drainage groove 454 is located at an intersection 458 of either of the top portion 74, bottom portion 174 and inner portion 258 of the exterior caps 46, 146, 230, 234 and the first 94, second 178, third 274 and fourth 278 ledges. The first drainage groove 454 extends from the first end 66, 162 to the second end 70, 166, and from the upper end 250 to the lower end 254 of the exterior caps 46, 146, 230, 234.

In yet another variant of the invention, as illustrated in FIG. 2B, the fifth exterior cap 350 of the muntin bar 346 further includes a second drainage groove 462. The second drainage groove 462 is located at an intersection 466 of either of the first 370 and second 374 portions of the fifth exterior cap 350 and the supporting ledges 394. The second drainage groove 462 extends from the first end 362 to the second end 362 of the fifth exterior cap 350 of the muntin bar 346.

In a further variant, as illustrated in FIGS. 2A, 2C, 3A and 3B, the first 46, second 146, third 230 and fourth 234 exterior caps further include a first sealant groove 466. The first sealant groove 466 is located on each of the first 94, second 178, third 274 and fourth 278 ledges. The first sealant groove 466 is spaced from an intersection 458 of either of the top portion 74, bottom portion 174 and inner portion 258 of the exterior caps 46, 146, 230, 234 and the first 94, second 178, third 274 and fourth 278 ledges. The first sealant groove 466 extends from the first end 66, 162 to the second end 70, 166, and from the upper end 250 to the lower end 254 of the exterior caps 46, 146, 230, 234.

In still a further variant, as illustrated in FIG. 2B, the fifth exterior cap 350 of the muntin bar 346 further includes a second sealant groove 470. The second sealant groove 470 is located on each of the supporting ledges 394 and spaced from an intersection 474 of either of the first 370 and second 374 portions of the fifth exterior cap 350 and the supporting ledges 394. The second sealant groove 470 extends from the first end 362 to the second end 362 of the fifth exterior cap 350 of the muntin bar 346.

In another variant of the invention, as illustrated in FIG. 2C, the bottom rail 42 further includes a first drip stop groove 478. The first drip stop groove 478 is located on the bottom portion 78 of the first exterior cap 46 and is spaced inwardly from and parallel to the outer surface 50 and extends from the first end 66 to the second end 70 of the first exterior cap 46. When the door construction 10 is located adjacent a ground surface 482, the first drip stop groove 478 will serve to prevent water from running underneath the bottom portion 78 of the bottom rail 42.

In yet another variant, as illustrated in FIGS. 3A and 3B at least one of the first 222 and second 226 side stiles further includes a second drip stop groove 486. The second drip stop groove 486 is located on the outer portion 262 of at least one of the third 230 and fourth 234 exterior caps and is spaced inwardly from and parallel to the outer surface 238. The second drip stop groove 486 extends from the upper end 250 to the lower end 254 of at least one of the third 230 and fourth 234 exterior caps. When the door construction 10 is located adjacent a second door construction 10, the second drip stop groove 486 will serve to prevent water from entering past the side stiles 222, 226.

In a final variant of the invention, as illustrated in FIGS. 3A and 3B, the outer portion 262 of either of the first 222 and second 226 side stiles meets the outer surface 238 of the side stiles 222, 226 at an angle 490 slightly greater than ninety degrees, thereby reducing binding when two such door constructions 10 are abutted together at the outer portions 262.

The composite door construction 10 has been described with reference to particular embodiments. Other modifications and enhancements can be made without departing from the spirit and scope of the claims that follow.

What is claimed is:

1. A composite door construction, comprising:

a transparent panel, said panel having an inner surface, an outer surface, an upper edge, a lower edge and first and second side edges;

a bottom rail, said bottom rail comprising:

a first exterior cap, said first cap being formed of weather-resistant material and having an outer surface, an inner surface, a first predetermined length, a first predetermined height, a first end, a second end, a top portion, a bottom portion, and a C-shaped cross-section forming an interior cavity, said top and bottom portions having a first predetermined thickness;

said top portion having a first ledge extending therefrom, said first ledge being sized and shaped to receive the lower edge of said transparent panel;

a first interior trim portion, said first trim portion having an outer surface, an inner surface, the first predetermined length, the first predetermined height, a first end, a second end, a top edge, a bottom edge and a rectangular cross-section;

said first trim portion including upper and lower receiving notches in said top and bottom edges, respectively, said receiving notches being disposed adjacent the outer surface of said first trim portion and having a depth equal to said first predetermined thickness;

said first interior trim portion being attached to said first exterior cap with said top and bottom portions disposed within said upper and lower receiving notches and the inner surface of said first trim portion disposed adjacent the inner surface of said first exterior cap;

a top rail; said top rail comprising:

a second exterior cap, said second cap being formed of weather-resistant material and having an outer surface, an inner surface, the first predetermined length, a second predetermined height, a first end, a second end, a top portion, a bottom portion, and a C-shaped cross-section forming an interior cavity, said top and bottom portions having the first predetermined thickness;

said bottom portion having a second ledge extending therefrom, said second ledge being sized and shaped to receive the upper edge of said transparent panel;

a second interior trim portion, said second trim portion having an outer surface, an inner surface, the first predetermined length, the second predetermined height, a first end, a second end, a top edge, a bottom edge and a rectangular cross-section;

said second trim portion including upper and lower receiving notches in said top and bottom edges, respectively, said receiving notches being disposed adjacent the outer surface of said second trim portion and having a depth equal to said first predetermined thickness;

said second interior trim portion being attached to said second exterior cap with said top and bottom portions disposed within said upper and lower receiving notches and the inner surface of said second trim portion disposed adjacent the inner surface of said second exterior cap;

first and second side stiles, said first and second side stiles comprising:

third and fourth exterior caps, each of said third and fourth caps being formed of weather-resistant material and having an outer surface, an inner surface, a second predetermined length, the second predetermined height, an upper end, a lower end, an inner portion, an outer portion, and a C-shaped cross-section forming an interior cavity, said inner and outer portions having the first predetermined thickness;

said inner portions having third and fourth ledges extending therefrom, said third and fourth ledges being sized and shaped to receive the first and second side edges of said transparent panel;

third and fourth interior trim portions, said third and fourth trim portions having an outer surface, an inner surface, the second predetermined length, the second predetermined height, a first end, a second end, an inner edge, an outer edge and a rectangular cross-section;

said third and fourth trim portions including inner and outer receiving notches in said inner and outer edges, respectively, said receiving notches being disposed adjacent the outer surface of said third and fourth trim portion and having a depth equal to said first predetermined thickness;

said third and fourth interior trim portions being attached to said third and fourth exterior caps with said inner and outer portions disposed within said inner and outer receiving notches and the inner surface of said third and fourth trim portions disposed adjacent the inner surface of said third and fourth exterior caps;

said bottom rail attached between said first and second side stiles adjacent lower ends thereof;

said top rail attached between said first and second side stiles adjacent upper ends thereof;

said transparent panel disposed upon said first, second, third and forth ledges;

upper and lower panel retention strips, said upper and lower strips being attached to said top and bottom rails, extending from said first side stile to said second side stile and serving to secure said upper and lower edges of said transparent panel;

first side and second side panel retention strips, said first side and second side strips being attached to said first side and second side stiles, extending from said top rail to said bottom rail and serving to secure said first and second side edges of said transparent panel; and whereby, when said top and bottom rails are attached between said first and second side stiles at upper and lower ends thereof, said transparent panel is disposed upon said first, second, third and forth ledges and secured in place with said upper and lower panel retention strips and said first side and second side panel retention strips, a door having a transparent panel will be formed.

2. A composite door construction, comprising:

at least two transparent panels, each of said panels having an inner surface, an outer surface, an upper edge, a lower edge and first and second side edges;

a bottom rail, said bottom rail comprising:

a first exterior cap, said first cap being formed of weather-resistant material and having an outer surface, an inner surface, a first predetermined length, a first predetermined height, a first end, a second end, a top portion, a bottom portion, and a C-shaped cross-section forming an interior cavity, said top and bottom portions having a first predetermined thickness;

said top portion having a first ledge extending therefrom, said first ledge being sized and shaped to receive the lower edge of said transparent panel;

a first interior trim portion, said first trim portion having an outer surface, an inner surface, the first predetermined length, the first predetermined height, a first end, a second end, a top edge, a bottom edge and a rectangular cross-section;

said first trim portion including upper and lower receiving notches in said top and bottom edges, respectively, said receiving notches being disposed adjacent the outer surface of said first trim portion and having a depth equal to said first predetermined thickness;

said first interior trim portion being attached to said first exterior cap with said top and bottom portions disposed within said upper and lower receiving notches and the inner surface of said first trim portion disposed adjacent the inner surface of said first exterior cap;

a top rail; said top rail comprising:

a second exterior cap, said second cap being formed of weather-resistant material and having an outer surface, an inner surface, the first predetermined length, a second predetermined height, a first end, a second end, a top portion, a bottom portion, and a C-shaped cross-section forming an interior cavity, said top and bottom portions having the first predetermined thickness;

said bottom portion having a second ledge extending therefrom, said second ledge being sized and shaped to receive the upper edge of said transparent panel;

a second interior trim portion, said second trim portion having an outer surface, an inner surface, the first predetermined length, the second predetermined height, a first end, a second end, a top edge, a bottom edge and a rectangular cross-section;

said second trim portion including upper and lower receiving notches in said top and bottom edges, respectively, said receiving notches being disposed adjacent the outer surface of said second trim portion and having a depth equal to said first predetermined thickness;

said second interior trim portion being attached to said second exterior cap with said top and bottom portions disposed within said upper and lower receiving notches and the inner surface of said second trim portion disposed adjacent the inner surface of said second exterior cap;

first and second side stiles, said first and second side stiles comprising:

third and fourth exterior caps, each of said third and fourth caps being formed of weather-resistant material and having an outer surface, an inner surface, a second predetermined length, the second predetermined height, an upper end, a lower end, an inner portion, an outer portion, and a C-shaped cross-section forming an interior cavity, said inner and outer portions having the first predetermined thickness;

said inner portions having third and fourth ledges extending therefrom, said third and fourth ledges being sized and shaped to receive the first and second side edges of said transparent panel;

third and fourth interior trim portions, said third and fourth trim portions having an outer surface, an inner surface, the second predetermined length, the second predetermined height, a first end, a second end, an inner edge, an outer edge and a rectangular cross-section;

said third and fourth trim portions including inner and outer receiving notches in said inner and outer edges, respectively, said receiving notches being disposed adjacent the outer surface of said third and fourth trim portion and having a depth equal to said first predetermined thickness;

said third and fourth interior trim portions being attached to said third and fourth exterior caps with said inner and outer portions disposed within said inner and outer receiving notches and the inner surface of said third and fourth trim portions disposed adjacent the inner surface of said third and fourth exterior caps;

said bottom rail attached between said first and second side stiles adjacent lower ends thereof;

said top rail attached between said first and second side stiles adjacent upper ends thereof;

at least one muntin bar, said muntin bar comprising:

a fifth exterior cap, said fifth cap being formed of weather-resistant material and having an outer surface, an inner surface, a first end, a second end, a first portion, a second portion, a central portion, and a T-shaped cross-section;

said central portion having a first predetermined width and a longitudinal groove;

each of said first and second portions having a supporting ledge extending therefrom, said supporting ledge being sized and shaped to receive an edge of one of said transparent panels;

a muntin bar interior trim portion, said muntin bar trim portion having an outer surface, an inner surface, the first predetermined width, a first end, a second end and a rectangular cross-section;

said muntin bar trim portion having a longitudinal tongue extending outwardly from the inner surface thereof;

said tongue being sized shaped and disposed to frictionally engage said groove in said central portion of said fifth exterior cap;

said muntin bar trim portion being attached to said central portion of said fifth exterior cap with the inner surface of said fifth cap abutting the inner surface of said muntin bar trim portion with said groove engaging said tongue;

said muntin bar extending from either of said top rail to said bottom rail and said first side stile to said second side stile;

each of said transparent panels disposed upon either of said first, second, third and forth ledges and one of said supporting ledges of said fifth exterior cap of said muntin bar;

upper and lower panel retention strips, said upper and lower strips being attached to said top and bottom rails, and serving to secure said upper and lower edges of said transparent panels;

first side and second side panel retention strips, said first side and second side strips being attached to said first side and second side stiles, and serving to secure said first and second side edges of said transparent panels;

muntin bar panel retention strips, said muntin bar panel retention strips being attached to said muntin bar interior trim portion and serving to secure said first and second side edges and said upper and lower edges of said transparent panels; and whereby, when said top and bottom rails are attached between said first and second side stiles at upper and lower ends thereof, said transparent panels are disposed upon said first, second, third, forth and supporting ledges and secured in place with said upper and lower panel retention strips, said first side and second side panel retention strips, and said muntin bar panel retention strips, a door having at least two transparent panel will be formed.

3. A composite door construction as described in claim 1, wherein the first, second, third and fourth interior trim portions further comprise:

a decorative inner panel, said decorative inner panel having an inside surface and an outside surface and extending from the outer surface of said trim portions toward the inner surface of said trim portions for a first predetermined distance;

a filler portion, said filler portion extending from the inside surface of said decorative inner panel to the inner surface of said trim portions;

said decorative inner panel being fixedly attached to said filler portion; and whereby, said filler portion is fabricated from less expensive materials, thereby reducing the cost of the door.

4. A composite door construction as described in claim 1, wherein said first, second, third and fourth exterior caps further comprise:

a first drainage groove, said first drainage groove disposed at an intersection of either of the top portion, bottom portion and inner portion of said exterior caps and the first, second, third and fourth ledges; and said first drainage groove extending from said first end to said second end and from said upper end to said lower end of said exterior caps.

5. A composite door construction as described in claim 2, wherein said fifth exterior cap of said muntin bar further comprises:

a second drainage groove, said second drainage groove disposed at an intersection of either of the first and second portions, of said fifth exterior cap and the supporting ledges; and said second drainage groove extending from said first end to said second end of said fifth exterior cap of said muntin bar.

6. A composite door construction as described in claim 1, wherein said first, second, third and fourth exterior caps further comprise:

a first sealant groove, said first sealant groove disposed upon each of said first, second, third and fourth ledges, and being spaced from an intersection of either of the top portion, bottom portion and inner portion of said exterior caps and the first, second, third and fourth ledges and said first sealant groove extending from said first end to said second end and from said upper end to said lower end of said exterior caps.

7. A composite door construction as described in claim 2, wherein said fifth exterior cap of said muntin bar further comprises:

a second sealant groove, said second sealant groove disposed upon each of said supporting ledges and spaced from an intersection of either of the first and second portions of said fifth exterior cap and the supporting ledges; and said second sealant groove extending from said first end to said second end of said fifth exterior cap of said muntin bar.

8. A composite door construction as described in claim 1, wherein the bottom rail further comprises:

a first drip stop groove, said first drip stop groove being disposed upon the bottom portion of the first exterior cap and being spaced inwardly from and parallel to the outer surface and extending from the first end to the second end of said first exterior cap; and whereby, when the door construction is disposed adjacent a ground surface, said first drip stop groove will serve to prevent water from running underneath the bottom portion of the bottom rail.

9. A composite door construction as described in claim 1, wherein at least one of the first and second side stiles further comprise:

a second drip stop groove, said second drip stop groove being disposed upon the outer portion of at least one of the third and fourth exterior caps and being spaced inwardly from and parallel to the outer surface and extending from the upper end to the lower end of at least one of said third and fourth exterior caps; and whereby, when the door construction is disposed adjacent a second door construction, said second drip stop groove will serve to prevent water from entering past said side stiles.

10. A composite door construction as described in claim 1, wherein the outer portion of either of said first and second side stiles meets the outer surface of either of said first and second side stiles at an angle slightly greater than ninety degrees, thereby reducing binding when two such door constructions are abutted together at said outer portions.

* * * * *